United States Patent [19]

Nakamura et al.

[11] Patent Number: 4,980,714

[45] Date of Patent: Dec. 25, 1990

[54] PHOTOSENSITIVE MATERIAL PROCESSING APPARATUS

[75] Inventors: Takashi Nakamura, Minami-ashigara; Toshio Kurokawa, Odawara, both of Japan

[73] Assignee: Fuji Photo Film Co., Ltd., Kanagawa, Japan

[21] Appl. No.: 499,746

[22] Filed: Mar. 27, 1990

[30] Foreign Application Priority Data

Apr. 19, 1989 [JP] Japan ..... 1-99855

[51] Int. Cl.[5] ..... G03D 3/02; G03D 3/08

[52] U.S. Cl. ..... 354/322; 354/324

[58] Field of Search ..... 354/316, 320, 321, 322, 354/324, 338, 339

[56] References Cited

U.S. PATENT DOCUMENTS 4,166,689 9/1979 Schausberger et al. ..... 354/321

4,710,009 12/1987 Schneider ..... 354/324

FOREIGN PATENT DOCUMENTS 1028216 5/1966 United Kingdom ..... 354/339

*Primary Examiner*—A. A. Mathews

*Attorney, Agent, or Firm*—Sughrue, Mion, Zinn, Macpeak & Seas

[57] ABSTRACT

In an apparatus comprising a plurality of processing compartments partitioned in a tank and each filled with a processing solution, a photosensitive material is successively passed through the compartments whereby the photosensitive material is processed by contact with the solution in each compartment. An outlet for discharging the solution is provided at a location other than the first and last compartments, usually at an intermediate compartment. A plurality of inlets for respectively supplying processing solutions having different functions can be provided at different locations so that the apparatus accomplishes two or more functions in a single tank. The apparatus becomes compact and the amount of processing solution replenished is reduced. A steady processing ability is maintained when the first compartment has a smaller volume than the remaining compartments and the solution is replenished to the system in a feedback control mode on the basis of a detected value representative of the amount of the solution supplied.

8 Claims, 14 Drawing Sheets

PHOTOSENSITIVE MATERIAL PROCESSING APPARATUS

CROSS-REFERENCE TO THE RELATED APPLICATION

This application is related to copending application Ser. No. 340,820 filed Apr. 20, 1989, for "Method and Apparatus for Processing Photosensitive Material" by Nakamura and Kurokawa, which is incorporated herein by reference.

FIELD OF THE INVENTION

This invention relates to an apparatus for wet processing a photosensitive material, typically a silver halide photosensitive material.

BACKGROUND OF THE INVENTION

In general, the wet processing of an exposed silver halide photosensitive material (to be simply referred to as a photosensitive material, hereinafter) includes a series of steps, typically development, fixation or bleach-fixation, and water rinsing. The series of steps are usually carried out in an automatic processor by successively transferring the photosensitive material through processing tanks filled with a developer, fixing solution, rinsing water and the like.

The recent general demands for environmental Q maintenance and resource saving are also imposed to this type of processing. In particular, a saving of a developer is a problem. Developing efficiency must be increased before the developer can be saved. It is known that developing efficiency can be increased in fact by using a plurality of developing tanks filled with a divided amount of developer.

It is also known that a saving of rinsing water can be accomplished by providing a plurality of rinsing tanks and effecting rinsing in a counter flow manner, that is, by passing rinsing water in a counter flow to the direction of travel of the photosensitive material.

One approach toward processing with a less amount of processing solution (developer or the like) is a so-called cascade processing system. In the cascade processing system, a plurality of, typically 2 to 9, processing tanks filled with the same type of processing solution are arranged in a side-by-side relationship. The photosensitive material is successively dipped in the tanks by advancing it between adjacent tanks in a crossover manner. In most cases, the processing solution also flows from a tank to a subsequent tank. The flow direction of the processing solution is not definite. With respect to the direction of travel of the photosensitive material, the flow of the processing solution may assume either the same direction, that is, a parallel flow or the opposite direction, that is, a counter flow.

The plurality of side-by-side arranged processing tanks, however, results in an apparatus of an increased size, requiring an increased space for installation. The photosensitive material contacts with air on every crossover movement between adjacent tanks, that is, it has many chances of contact with air during processing. The necessity to compensate for a deterioration by oxidation with air prevents the amount of developer consumed or replenished from being reduced to a desired extent.

SUMMARY OF THE INVENTION

Therefore, an object of the present invention is to provide a novel and improved photosensitive material processing apparatus of a reduced size and capable of processing with a less amount of processing solution.

Another object of the present invention is to provide such a processing apparatus capable of maintaining the ability of processing solution constant.

According to the present invention, there is provided a photosensitive material processing apparatus comprising a processing tank, a plurality of processing compartments partitioned in said tank, the processing compartments being in serial communication to define a continuous processing path which is filled with a processing solution, and means for successively passing a photosensitive material through the processing compartments along the path whereby the photosensitive material is processed by contact with the processing solution in each compartment. An inlet is provided in fluid communication with the path for supplying the processing solution thereto. At least one outlet is provided in fluid communication with the path for discharging the processing solution therefrom. The outlet being positioned at a location other than the first compartment through which the photosensitive material passes first and the last compartment through which the photosensitive material passes last.

Preferably, at least three processing compartments are partitioned in the tank, and the outlet is connected to an intermediate compartment between the first and last compartments. Most often, the path includes a channel for providing flow communication between the compartments, and the outlet may be connected to the channel.

Preferably, a plurality of inlets for respectively supplying a corresponding plurality of processing solutions having different functions are provided at different locations. One inlet is provided at a location nearer to the first compartment and another inlet is provided at a location nearer to the last compartment with respect to the outlet.

Processing efficiency is further improved when the compartment to which the processing solution is first supplied has a smaller volume than the remaining compartments. There is provided means for detecting the amount of the processing solution supplied to the path and controlling the amount of the processing solution to be supplied to the path on the basis of the detected value.

Where the processing solution has desilvering ability, the inlet is provided in direct flow communication with the first compartment so that the processing solution is first supplied to the first compartment.

The processing apparatus is preferably designed such that the photosensitive material is successively passed through the series of processing compartments without contact with ambient air.

The last-mentioned design is the subject matter of copending application Ser. No. 340,820 filed Apr. 20, 1989, for "Method and Apparatus for Processing Photosensitive Material" by Nakamura and Kurokawa. It discloses, a method for wet processing a silver halide photosensitive material, comprising the steps of: providing a processing tank whose interior chamber is partitioned into a plurality of serially arranged compartments filled with a processing solution, and successively passing the photosensitive material through the compartments without contact with the ambient atmosphere. Also disclosed is an apparatus for wet processing a photo sensitive material, comprising: a processing tank for defining an interior chamber, means for partitioning the tank chamber into a plurality of serially arranged compartments, the compartments being filled with processing solution, and means for successively passing the photosensitive material through the compartments while maintaining continuous contact with the solution.

The processing solution applicable to one processing tank used in this method and apparatus is either one of a developer, bleach-fixing solution and rinsing water. The processing solution is supplied and discharged into the tank primarily at the first compartment through which the photo. sensitive material passes first and the last compartment through which the photosensitive material passes last. The flow of the processing solution is unidirectional throughout the apparatus, that is, either in the same direction (in the case of a developer or bleach-fixing solution) or in the opposite direction (in the case of rinsing water) with respect to the direction of travel of the photosensitive material.

The present invention is an improvement over the previously proposed apparatus.

According to the present invention, at least one outlet port for discharging the processing solution is provided at a location other than the first and last compartments. Then at least two streams of solution flowing toward the outlet port are created. It is then possible to supply two or more types of processing solution having different functions at two or more locations. Differently stated, different types of processing can be effected at opposite sides of the outlet port. If intermixing of different types of processing solution is inconvenient as will be described later, water or any suitable fluid may be supplied at the interface between the different types of processing solution for the purpose of isolation. Then the solutions are diluted before they are discharged.

The present invention allows a single processing tank to have two or more different functions and contributes to a size reduction, presenting a more compact processor. By selecting a proper combination of two or more types of processing solution, processing efficiency can be accordingly increased. Then the amount of processing solution replenished can be further reduced.

Processing efficiency is improved partly because a tank is partitioned into a plurality of processing compartments so that a concentration gradient in solution composition is maintained between adjoining compartments in the flow direction of the solution. This advantage is observed in the apparatus of the invention among the compartments filled with a processing solution having an identical function.

In an embodiment where a plurality of partitioned compartments are in fluid communication through narrow channels, the adjoining compartments are rather loosely isolated from each other in order to facilitate passage of the photosensitive material. Such loose shutting makes it difficult to maintain a concentration gradient in solution composition between the adjoining compartments. This causes a problem particularly when processing is restarted after a quiescent period. Our approach to overcome the problem is that the compartment to which the processing solution is first supplied has a smaller volume than the remaining compartments. When processing is restarted after a quiescent period, the solution in this smaller volume compartment is shortly displaced by a fresh solution so that processing efficiency is improved.

When the amount of solution to be supplied to the system is controlled on the basis of a detected value of an actual amount of solution supplied, a replenishment error which would otherwise occur in such a smaller volume compartment can be minimized. A precision replenishment maintains the processing ability constant.

The processing apparatus of the invention is advantageously operated with a processing solution having a desilvering ability. In one preferred embodiment, a bleaching solution is supplied to the first compartment which the photosensitive material enters first, a fixing solution is supplied to the last compartment from which the U photosensitive material exits, and the mixed solution is discharged through an outlet port in an intermediate compartment. Then the apparatus can carry out a desilvering process including bleaching →bleach-fixing→fixing steps. Also in this case, the first compartment to which the bleaching solution is supplied has a smaller volume than the remaining compartments. Supply of the bleaching solution to the system is controlled on the basis of a detected value of an actual amount of bleaching solution supplied. This approach avoids a variation in processing ability of the bleaching solution due to drag-out of another processing solution (e.g., color developer) from the preceding tank or a replenishment error, also maintaining the processing ability constant.

BRIEF DESCRIPTION OF THE DRAWINGS

The above and other objects, features and advantages of the present invention will be better understood from the following description taken in conjunction with the accompanying drawings, in which.

In the figures, like numerals designate like parts.

DESCRIPTION OF THE PREFERRED EMBODIMENTS

The photosensitive material which is processed in the apparatus generally takes the form of a web or sheet. The processing solution is used in the present invention in a broader sense as encompassing a wide variety of fluid ranging from wash liquid as typified by water to ordinary processing solutions in a common sense in the photographic art, typically developing and bleach-fix solutions. More particularly, the ordinary processing solutions which can be used in the apparatus of the present invention include developing, fixing, bleaching, bleach-fix, and reversing solutions.

Figure 1:
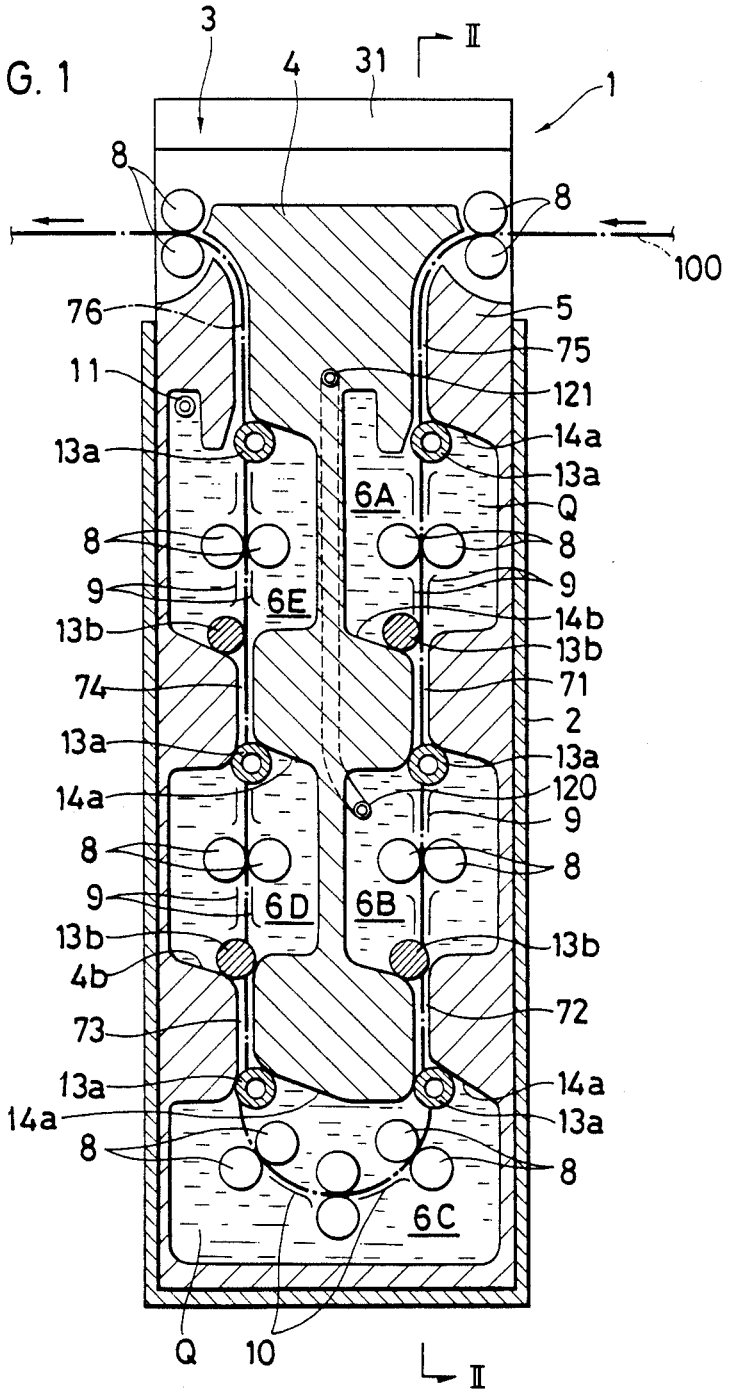
FIG. 1 is a vertical cross section of a photosensitive material processing apparatus according to one preferred embodiment of the present invention.
Figure 2:
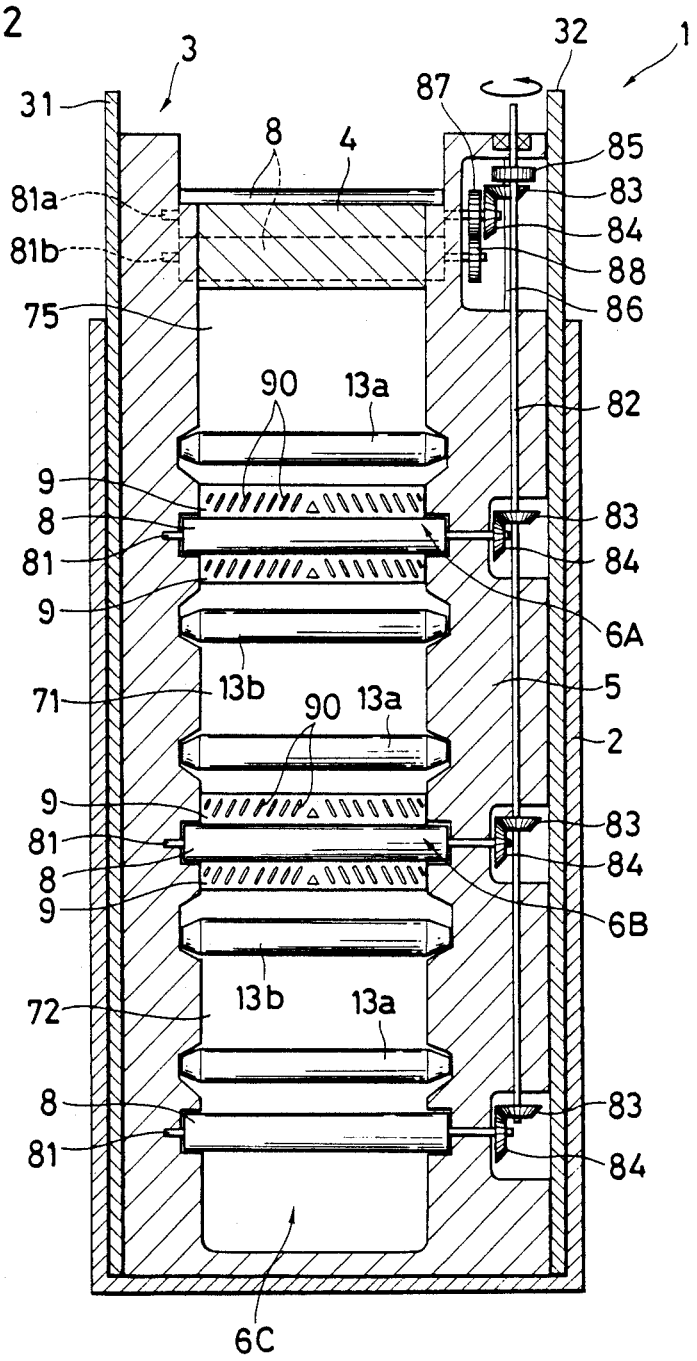
FIG. 2 is a cross section taken along lines II—II in FIG. 1.

FIGS. 1 and 2 illustrate a processing apparatus according to one preferred embodiment of the present invention.

The processing apparatus generally designated at 1 is illustrated as comprising a vertical elongated housing or tank 2 and a rack assembly 3 accommodated therein. The rack assembly 3 includes a pair of side plates 31 and 32 and blocks 4 and 5 mounted therebetween.

The central block 4 is disposed inside the outer block 5. The blocks 4 and 5 are configured such that when placed in register as shown in FIG. 1, five serially arranged compartments 6A, 6B, 6C, 6D and 6E are defined therebetween for processing a photosensitive material in the form of a photosensitive sheet or web 100. The blocks 4 and 5 placed in register also define narrow channels 71, 72, 73 and 74 between two adjoining compartments 6A and 6B, 6B and 6C, 6C and 6D, and 6D and 6E for fluid communication and sheet passage therebetween. The blocks 4 and 5 further define similar narrow first and last channels 75 and 76 above the sensitive material exits the tank is designated a last compartment.

The blocks 4 and 5 are solid members in the illustrated embodiment, but may be hollow members which can be blow molded, for example. The blocks 4 and 5 may be formed of a resin or other material as long as they can be molded or machined to a relatively complex configuration as shown in the figures. They are usually formed of a hard material which is durable, undergoes no deformation, expansion or weakening under the action of processing solution, and does not deteriorate processing solution to adversely affect photographic properties. Preferred examples of such material include various resins such as polyethylene, polypropylene, polyphenylene oxide (PPO), ABS resins, phenolic resins, polyesters, and polyurethane resins, ceramics such as alumina, and corrosion resistant metals such as stainless steel, titanium and its alloys, and a mixture thereof. Plastic materials such as polypropylene, PPO and ABS resins are preferred for ease of molding, light weight, and strength.

The breadth or gap distance of the channels 71 to 76 is preferably about 5 to 40 times the thickness of the photo sensitive sheet 100. The channels of such a breadth allow the photosensitive sheet 100 to travel therethrough without any disturbance. These dimensions are determined for the illustrated embodiment where the channels 71 to 76 are provided with shutter means to be described later although the channels may have a similar breadth, but an increased longitudinal distance when no shutter means is provided. For facilitated passage, the channels 71 to 76 on the opposed surfaces may be chemically treated to be water repellent or mechanically corrugated.

Disposed approximately at the center in each of the processing compartments 6A, 6B, 6D, and 6E are a pair of feed rollers 8. Three pairs of feed rollers 8 are disposed in the processing compartment 6C at the lowermost stage.

Disposed in proximity to the inlet of the first channel 75 are a pair of entrance rollers 8 for carrying the photosensitive sheet 100 into the tank or processing solution Q in the first compartment 6A. Disposed in proximity to the outlet of the last channel 76 are a pair of exit rollers 8 for carrying the photosensitive sheet 100 out of the tank or processing solution from the last compartment 6E.

These feed rollers 8 are pivotally supported to the blocks 4 and 5 as shown in FIG. 2. In each of roller pairs, Q either or both of the rollers in frictional contact with each other are driven for rotation so that the paired rollers can carry the photosensitive sheet 100 forward while clamping it therebetween.

The drive mechanism for the rollers 8 is illustrated in FIG. 2. A vertical drive shaft 82 extends through a bore in the side block 5. Bevel gears 83 are fixedly secured to the shaft 82 at predetermined positions. Each of the feed rollers 8 includes a horizontally extending shaft 81 having a bevel gear 84 fixedly secured to one end thereof. The bevel gear 84 on the roller shaft 81 is in mesh with the bevel gear 83 on the drive shaft 82. Then, each feed roller 8 can be rotated by rotating the drive shaft 82 in a predetermined direction by means of a suitable drive such as a motor (not shown).

The entrance rollers 8 also have horizontally extending shafts 81*a* and 81*b* somewhat offset from the drive shaft 82 (the entrance rollers 8 are off the vertical line connecting the feed rollers 8 as seen from FIG. 1). A gear 85 is fixedly secured to the drive shaft 82. A driven shaft 86 is Q supported parallel to the drive shaft 82 and coupled to the drive shaft 82 through a gear train including the gear 85 on the drive shaft 82. A bevel gear 83 is fixedly secured to the driven shaft 86. Another bevel gear 84 is fixedly secured to the shaft 81*a* of one roller at one end thereof. The bevel gear 84 on the roller shaft 81*a* is in mesh with the bevel gear 83 on the driven shaft 86. The roller shaft 81*a* also has a gear 87 secured thereto inside the bevel gear 84, which is in mesh with a gear 88 secured to the shaft 81*b* of the other roller 8 at one end thereof. Then both the rollers 8 are simultaneously rotated with the rotation of the drive shaft 82.

For each pair of feed rollers 8 in the processing compartment, one roller is driven for rotation and the other roller is rotated therewith due to frictional engagement between their peripheral surfaces. It is possible to couple Q the rollers of each pair through gears so that both the rollers are driven for rotation as in the case of the entrance rollers 8.

The rollers may preferably be formed of a material which is durable, undergoes no deformation, expansion or weakening under the action of processing solution, and does not deteriorate processing solution to adversely affect photographic properties. Examples of the roller-forming material include various rubbers such as neoprene and EPT rubber; elastomers such as Sunprene (flexible vinyl chloride compound, Mitsubishi Monsanto K.K.), Thermolan, and Hytrel; various resins such as rigid vinyl chloride resin, polypropylene, polyethylene, ABS resin, PPO, nylon, POM, phenolic resin, silicone resin and Teflon; ceramic materials such as alumina; corrosion resistant metals such as stainless steel, titanium and its alloy and Hastelloy, and a mixture thereof.

Disposed above and below the feed rollers 8 in each of the compartments 6A, 6B, 6D and 6E are two pairs of guide plates 9 for guiding the photosensitive sheet 100. Disposed between the feed rollers 8 in the lowest compartment 6C are reverse guides 10 in the form of an arcuate plate for assisting in reversing the travel direction of the photosensitive sheet 100.

These guide members 9 and 10 may be of sheet metal or molded plastic material. Often the guide members are formed with perforations 90 distributed approximately uniformly thereon. The perforations 90 in the guide members 9 and 10 allow passage of processing solution therethrough, resulting in promoted circulation of processing solution and increased processing efficiency.

These guide members 9, 10 and the feed rollers 8 cooperate with their drive system to construct transfer means for carrying the photosensitive material 100 along the predetermined path.

Each of the compartments 6A to 6E and channels 71 to 74 is filled with the processing solution Q and a fresh processing solution or replenisher is supplied when the photosensitive material 100 is being processed. In the illustrated embodiment, a conduit for supplying a fresh processing solution or replenisher terminates at an inlet port 11 which is located in the wall defining the last compartment 6E. The processing solution is thus introduced into the last compartment 6E through the inlet port 11.

The processing solution is discharged out of the apparatus through an outlet port provided at a location Q other than the first compartment 6A through which the photosensitive material passes first and the last compartment 6E through which the photosensitive material passes last. In the illustrated embodiment, a conduit 12 for discharging the processing solution terminates at an outlet port 120 which is located in the wall defining the second compartment 6B. Another end 121 of the discharge conduit 12 is located at a level approximate to the surface of the overall processing solution Q so that the (exhausted) processing solution may be discharged from the second compartment 6B through the discharge conduit 12 in an overflow manner.

The position and number of inlet and outlet ports 11 and 120 are not limited to the illustrated embodiment. For example, the inlet and outlet ports can be opened at an intermediate of any of the channels 71 to 74. The discharge of the processing solution through the discharge conduit 12 is not limited to the overflow mode, but the solution may be forcedly removed by a pump or suction means.

Since the interior of the tank is partitioned into a plurality of processing compartments 6A to 6E in controlled flow communication, the volumes of processing solutions in the respective compartments 6A to 6E have gradients in concentration or composition, which are effective for efficient processing. The channels 71 to 74 is narrow enough to provide controlled flow communication between the compartments 6A to 6E, so that the volumes of processing solution Q do not flow or intermix more than as necessary. Thus the gradient in solution composition is well maintained in the apparatus 1 illustrated herein.

Disposed at the transitions between the processing compartments 6A to 6E and the channels 71 to 76 are shutter means for shutting or closing the transitions during quiescent periods when no photosensitive sheet 100 travels. The shutter means are formed by valves **13*a* and 13*b* in the illustrated embodiment. Both the upper and lower valves 13*a* and 13*b* are in the form of a cylinder or roller having tapered or frustoconical portions at axially opposed ends as shown in FIG. 2**, but they are somewhat different in detail.

The upper valve **13*a* is located adjacent the upper opening of each compartment to the corresponding channel for blocking the opening. To this end, the valve 13*a* is formed to have a lower specific gravity than the processing solution such that the valve may float up due to buoyancy. In contrast, the lower valve 13*b* is located adjacent the lower opening of each compartment to the corresponding channel for blocking the opening. To this end, the valve 13*b*** is formed to have a higher specific gravity than the processing solution such that the valve may sink to the bottom.

The upper and lower valves **13*a* and 13*b* may be given a selected specific gravity by a choice of proper material. When the upper and lower valves 13*a* and 13*b* are solid cylinders, the upper cylinders 13*a* may be formed of a foamed plastic material such as foamed polypropylene, foamed polyphenylene oxide (PPO), and foamed acrylonitrile-butadiene-styrene (ABS), and the lower cylinders 13*b*** may be formed of a rigid plastic material such as rigid polyvinyl chloride, ABS resin and PPO.

It is also possible to form the upper valves **13*a* from a material having a higher specific gravity than the processing solution by molding a hollow cylinder having buoyancy as shown in cross section in FIG. 1. As to the lower valves 13*b***, their overall specific gravity may be increased, if desired, for example, by inserting a core of metal or other heavy material (not shown).

From the point of view of providing an improved seal against the channels 71 to 76, it is preferred to form the valve cylinders **13*a* and 13*b* from an elastomeric material such as silicone rubber and various other elastomers or to cover the periphery of the valve cylinders 13*a* and 13*b*** with such elastomeric material.

Inclined surfaces **14*a* and 14*b* are provided on the compartment-defining upper and lower walls of the blocks 4 and 5. The upper surface 14*a* is upwardly inclined toward the opening of each compartment to the channels. The lower surface 14*b*** is downwardly inclined toward the opening of each compartment to the channels.

These valves **13*a* and 13*b* block the access openings of the compartments to the channels 71 to 76 during quiescent periods when no photosensitive sheet 100 travels, but allow passage of photosensitive sheet 100 when they are moved aside by the incoming photosensitive sheet 100 to tumble along the inclined surfaces 14*a* and 14*b*. After the photo sensitive sheet 100 has passed, the valves 13*a* and 13*b* resume their original position to block the access openings of the compartments to the channels 71 to 76** again.

The shutter means for normally blocking the openings of the compartments 6A to 6E to the channels, but permitting passage of the photosensitive sheet 100 is not limited to the illustrated embodiment. There may be employed mechanical shutter means using a movable shutter plate, fluid shutter means using fluid such as paraffin, liquid crystal and oil as disclosed in Japanese Patent Application No. 142464/1988, shutter means using magnetic fluid, roller shutter means as disclosed in Japanese Patent Application No. 94755/1988, and squeezer shutter means as disclosed in Japanese Patent Application No. 94756/1988, shutter plates operably associated with a crank mechanism as disclosed in Japanese Patent Application No. 27034/1989 as well as other shutter mechanisms using gaskets and labyrinth seals.

Provision of shutter means is not necessarily needed for the apparatus of the invention.

With the above-illustrated arrangement, the photosensitive sheet 100 is carried into the processing solution Q in the first compartment 6A of the tank by the entrance rollers 8, successively passed through the serially arranged compartments 6A to 6E along a generally U-shaped pathway where it is processed, and finally carried out of the processing solution in the last compartment 6E by the exit rollers 8. While the photosensitive sheet 100 is serially passed through the compartments 6A to 6E, it maintains continuous contact with the processing solution. That is, the photosensitive sheet 100 is passed through the processing solution in the serially arranged compartments 6A to 6E without contact with the ambient atmosphere. This avoids the crossover transfer of a photosensitive material through the ambient atmosphere between adjacent compartments in the prior art cascade processing apparatus, leading to several benefits including elimination of crossover transfer time, saving of replenisher, and improved photographic properties.

The construction of the photosensitive material processing apparatus of the invention has been illustrated in conjunction with FIGS. 1 and 2 although the invention is not limited thereto. Any processing tanks having a plurality of processing compartments are applicable to the invention, for example, a tank having a processing path consisting of narrow slit segments as described in Japanese Patent Application No. 61707/1989, and a processing tank whose interior is partitioned by rollers and partition members.

The pattern in which inlet and outlet ports for the processing solution are located according to the invention can have several variants, which are illustrated in FIGS. 3 to 12.

FIGS. 3 to 12 schematically illustrate only the contour of processing compartments and channels, and all the remaining components including the processing tank, blocks, feed rollers, and guides are omitted for brevity of illustration. In the figures, various processing solutions are shown by symbols, that is, D designates a developer, FD a first developer, CD a second developer, A an acid such as $H_2SO_4$, HCl, and $CH_3COOH$, N an alkali such as NaOH, KOH, $Na_2CO_3$, $Na_3PO_4$, and amines (e.g., triethanolamine), W water, Bl a bleaching solution, F a fixing solution, SB a stabilizing solution, and R a reversing solution. The position at which each solution is fed, that is, the location of an inlet port is shown by a thick arrow. The direction of travel of photosensitive material 100 is shown by solid arrows. The compartment which is n-th (wherein n=1, 2, 3, . . . ) as counted from the entrance of photosensitive material 100 is called the n-th compartment.

[1]

Figure 3:
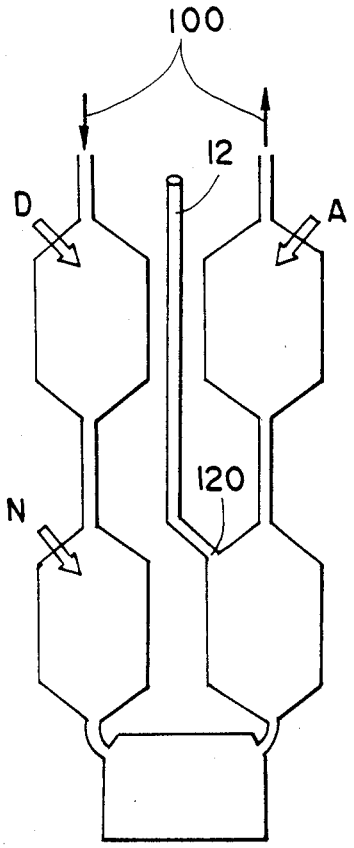
FIGS. 3 through 12 are schematic illustrations of different patterns for processing solution supply and discharge applicable to the photosensitive material processing apparatus of the present invention.

FIG. 3 illustrates a first pattern in which developer D is delivered into the first compartment, alkali N into the second compartment, and acid A into the fifth compartment while the solution is discharged from the fourth compartment through the outlet port 120.

The alkali N (typically NaOH) supplied at the second compartment is effective in regenerating the developer. More particularly, some components are dissolved out of the photosensitive material and the activity of the developer is reduced thereby. Addition of alkali can increase the pH of the developer to enhance the activity of the developing agent. Sufficient developing activity is thus maintained without making up an additional developer or replenisher. As a result, apparent regeneration of the developer is accomplished.

In the fourth and fifth compartments, the acid acts to remove developer components which have been incorporated in the emulsion layer of photosensitive material 100, thereby inhibiting occurrence of thermostains after processing and bleach fog in the subsequent step. In particular, the color developing agent is incorporated in the oil in the photosensitive material and thus difficult to remove. The addition of an acid permits the color developing agent to be readily dissolved out of the photosensitive material into the processing solution because the agent is well soluble in acid. Since the developing agent which is dissolved out into the acid solution in the fifth compartment is moved back to the fourth compartment, the developing agent is reused in such an efficient manner as to reduce the amount of developer replenished. The amount of developer replenished is further reduced by this feature along with the addition of an alkali (NaOH) midway the developing process.

[2]

Figure 4:
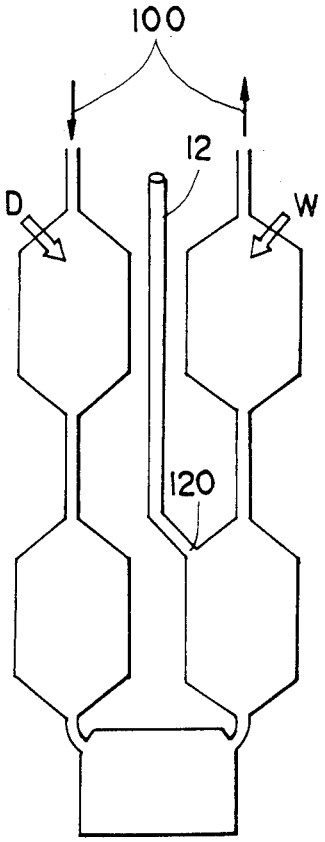

FIG. 4 illustrates a second pattern in which developer D is delivered into the first compartment and water W into the fifth compartment while the solution is discharged from the fourth compartment through the outlet port 120.

The water supplied to the fifth compartment removes or dilutes developer components which have been incorporated in the emulsion layer of photosensitive material 100 in the fourth and fifth compartments, thereby inhibiting occurrence of thermostains after processing and bleach fog in the subsequent step.

Post-development fog during water rinsing is substantially inhibited because the rinsing water does not contact the ambient air.

[3]

Figure 5:
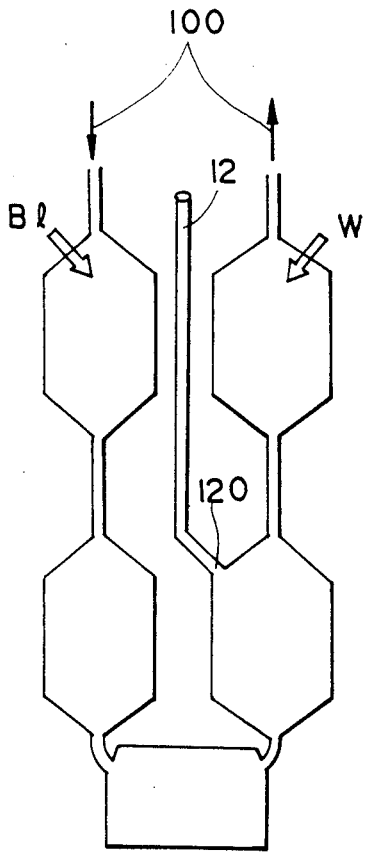

FIG. 5 illustrates a third pattern in which bleaching solution Bl is delivered into the first compartment and water W into the fifth compartment while the solution is discharged from the fourth compartment through the outlet port 120.

The water supplied to the fifth compartment dilutes the bleaching solution in the fourth and fifth compartments, suppressing drag-out of bleaching components to a subsequent step or a fixing solution. Then the step of recovery of silver (desilvering) in the fixing solution is facilitated.

Since there is no need to pay attention to the acid decomposition of the fixing solution in the subsequent step, Q a bleaching solution with a lower pH value can be used so that a higher bleaching power is available with a less amount of oxidizing agent.

[4]

Figure 6:
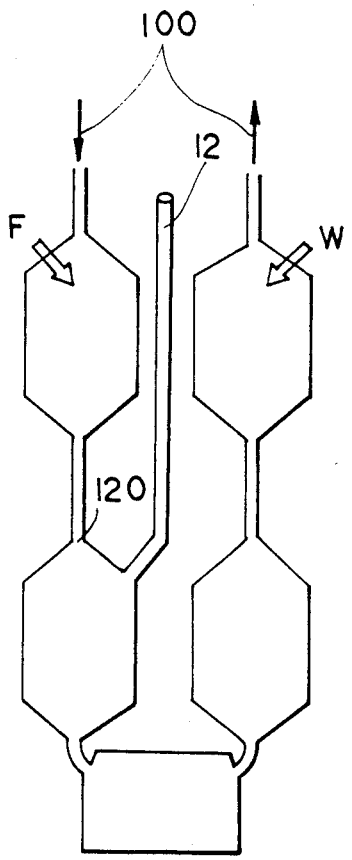

FIG. 6 illustrates a fourth pattern in which fixing solution F is delivered into the first compartment and water W into the fifth compartment while the solution is discharged from the second compartment through the outlet port 120.

In this embodiment, fixation is effected primarily in the first and second compartments before water rinsing is effected in the third and subsequent compartments. That is, one processing tank serves for two functions of fixation and water rinsing. This feature eliminates a need for a separate rinsing tank, resulting in a saving of the installation space of the overall processing tank.

When the photosensitive material 100 is transferred to a subsequent step or drying, only a reduced amount of fixing components is left in the emulsion layer. This feature allows the photosensitive material 100 to show improved shelf stability after processing, inhibits occurrence of thermostains, and inhibits fading of cyan dyes in the case of a color photosensitive material.

[5]

Figure 7:
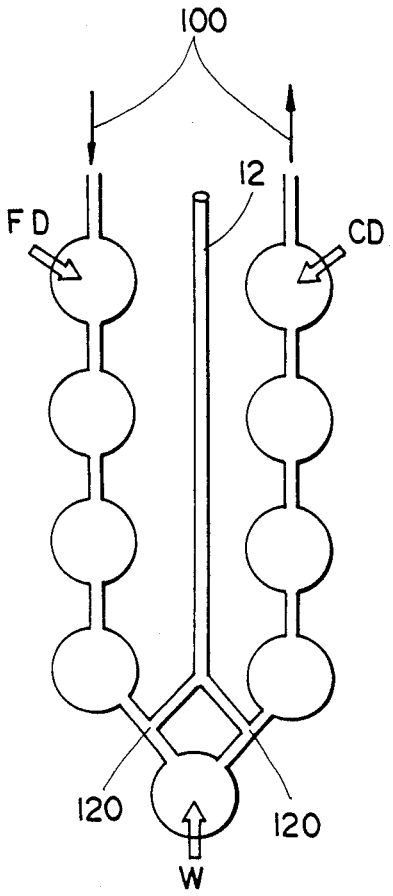

FIG. 7 illustrates a fifth pattern in which first Q developer FD is delivered into the first compartment, water W into the fifth compartment, and second developer CD into the ninth compartment while the solution is discharged from the channels between the fourth and fifth compartments and between the fifth and sixth compartments through the outlet ports 120.

In this embodiment, first development is effected in the first to fourth compartments in a parallel flow manner and second development is effected in the fifth to ninth compartments in a counter flow manner. If first developer FD intermixed with second developer CD, photographic properties would be lost. The developers are kept isolated by supplying water W into the fifth compartment and locating the outlet ports 120 at the opposite sides thereof Satisfactory photographic properties are expectable from this water isolation.

[6]

Figure 8:
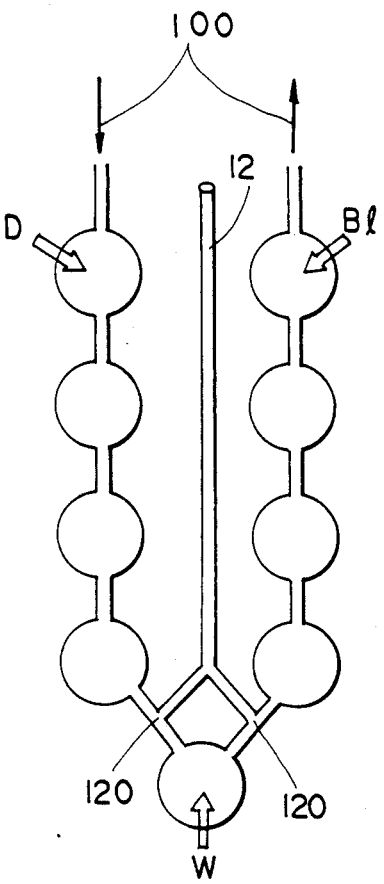

FIG. 8 illustrates a sixth pattern in which developer is delivered into the first compartment, water W into the fifth compartment, and bleaching solution Bl into the ninth compartment while the solution is discharged from the channels between the fourth and fifth compartments and between the fifth and sixth compartments through the outlet ports 120.

In this embodiment, development is effected in the first to fourth compartments in a parallel flow manner and bleaching is effected in the fifth to ninth compartments in a counter flow manner. If developer D intermixed with bleaching solution Bl, photographic properties would be lost. The developer and bleaching solution are kept isolated by supplying water W into the fifth compartment and locating the outlet ports 120 at the opposite sides thereof. Satisfactory photographic properties are expectable from this water isolation.

The developer and bleaching solution can be independently collected by connecting two separate discharge conduits 12 to the outlet ports 120 in the channels between the fourth and fifth compartments and between the fifth and sixth compartments. This facilitates regeneration of the bleaching solution.

[7]

Figure 9:
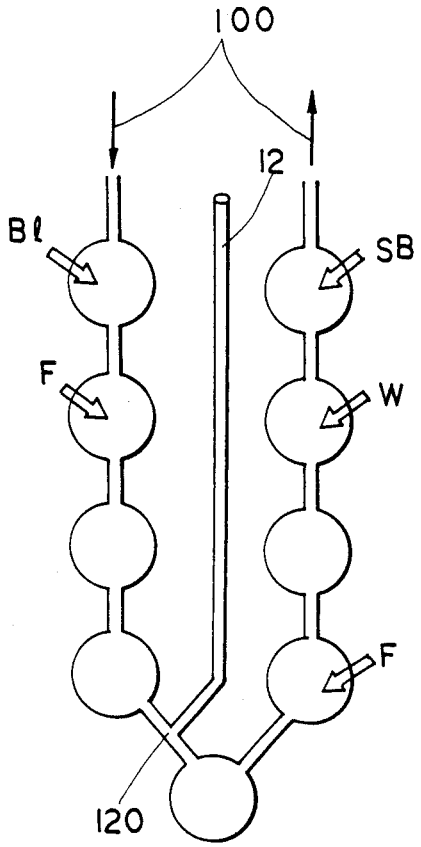

FIG. 9 illustrates a sixth pattern in which bleaching solution Bl is delivered into the first compartment, fixing solution F into the second and sixth compartments, water W into the eighth compartment, and stabilizing solution SB into the ninth compartment while the solution is discharged from the channel between the fourth and fifth compartments through the outlet port 120.

This embodiment uses only one processing tank in successively carrying out five different processing steps, bleaching (in the first compartment), bleach fixation (in the second to fourth compartments), fixation (in the fifth and sixth compartments), water rinsing (in the seventh and eighth compartments), and stabilization (in the ninth compartment). This feature of imparting multiple functions to the single processing tank is effective not only in reducing the amount of each processing solution replenished, but also in reducing the processing time because the time required for crossover travel through air between adjacent once incorporated in the emulsion layer, thereby inhibiting occurrence of thermostains after processing.

[8]

Figure 10:
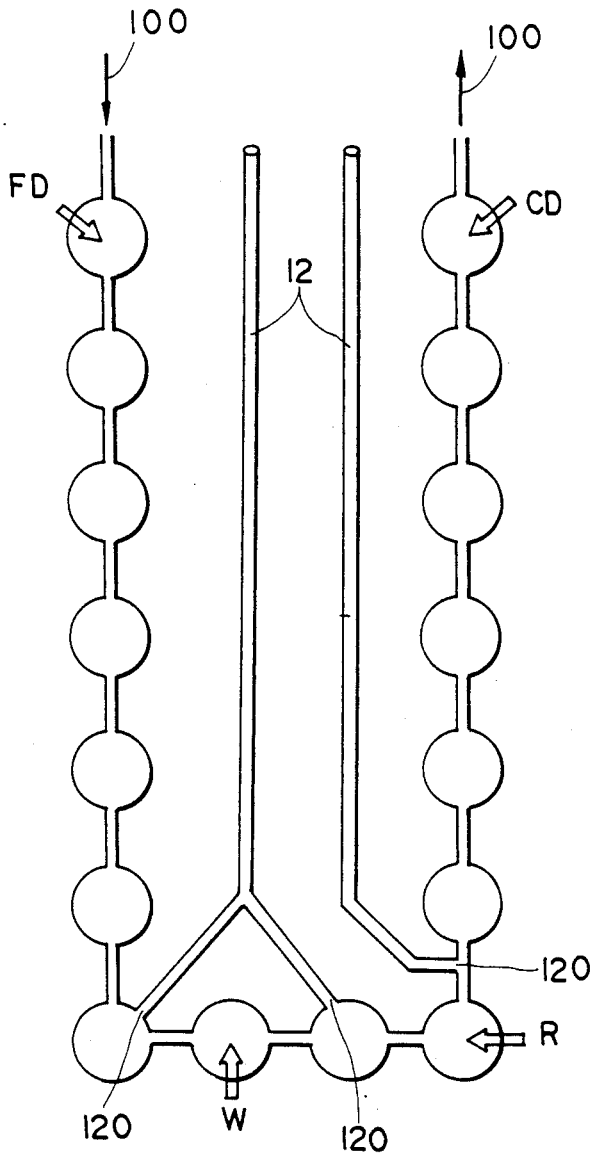

FIG. 10 illustrates a seventh pattern in which first developer FD is delivered into the first compartment, water W into the eighth compartment, reversing solution R into the tenth compartment, and second developer CD into the sixteenth compartment while the solution is discharged from the seventh and ninth compartments and the channel between the tenth and eleventh compartments through the outlet ports 120.

This embodiment uses only one processing tank in successively carrying out multiple processing steps, first development, reversal, and second development. The water W supplied into the 8th compartment serves to isolate the first developer FD and the reversing solution R one another. Satisfactory photographic properties are expectable from this water isolation.

Although the prior art required at least four processing tanks to achieve four different processing functions, the system of FIG. 10 can accomplish four functions with a single tank.

[9]first

Figure 11:
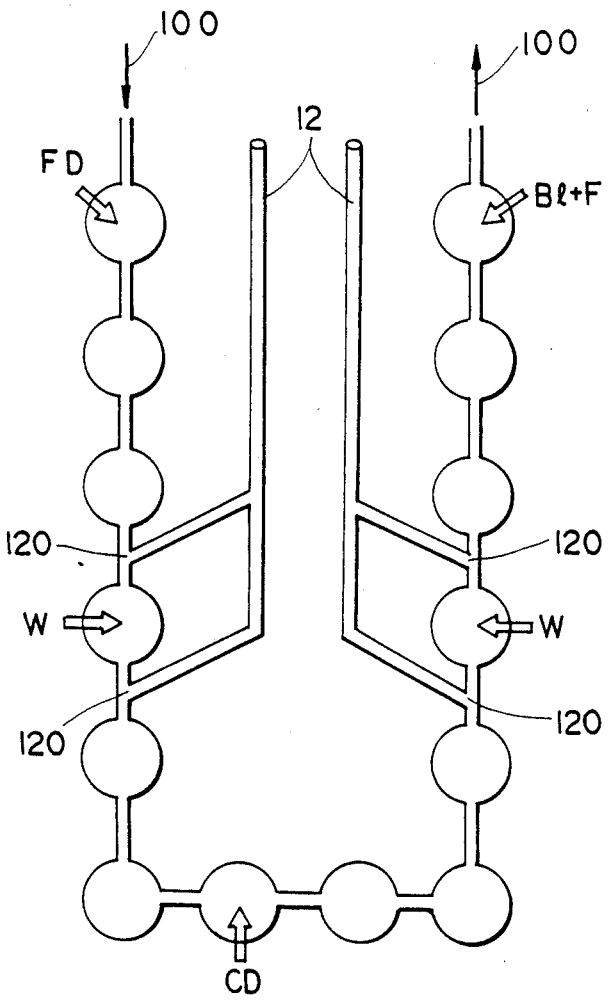

FIG. 11 illustrates an eighth pattern in which developer FD is delivered into the first compartment, water W into the fourth and eleventh compartments, second developer CD into the seventh compartment, and bleach-fixing solution Bl+F into the fourteenth compartment while the solution is discharged from four outlet ports 120 at opposite sides of the fourth and eleventh compartments.

This embodiment uses only one processing tank in successively carrying out multiple processing steps, first development, second development, and bleach fixation. The water W supplied into the 4th and 11th compartments serves to isolate the first developer FD from the second developer CD and the second developer CD from the bleach fixing solution Bl+F. Satisfactory photographic properties are expectable from this water isolation.

The system of FIG. 11 can accomplish five functions with a single tank.

[10]

Figure 12:
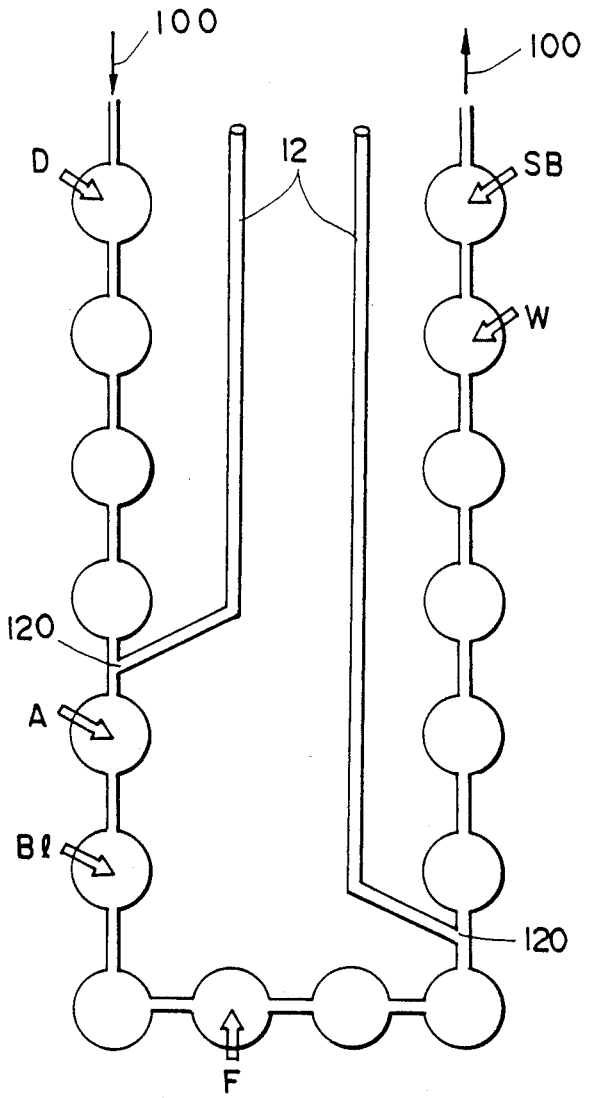

FIG. 12 illustrates a ninth pattern in which developer D is delivered into the first compartment, acid A into the fifth compartment, bleaching solution Bl into the sixth compartment, fixing solution F into the eighth compartment, water W into the fifteenth compartment, and stabilizing solution SB into the sixteenth compartment while the solution is discharged from two outlet ports 120 in the channels between the fourth and fifth compartments and between the tenth and eleventh compartments.

This embodiment uses only one processing tank to successively carry out multiple processing steps, development, stop, bleaching, bleach-fixation, fixation, water rinsing, and stabilization.

The introduction of acid A into the 5th compartment maintains the bleaching solution active and stops further development of the photosensitive material prior to the bleaching step, thereby inhibiting occurrence of bleach stains.

Several variants of the multi-compartment system with an outlet port connected to or associated with an inter mediate compartment have been illustrated although the invention is not limited thereto.

Figure 13:
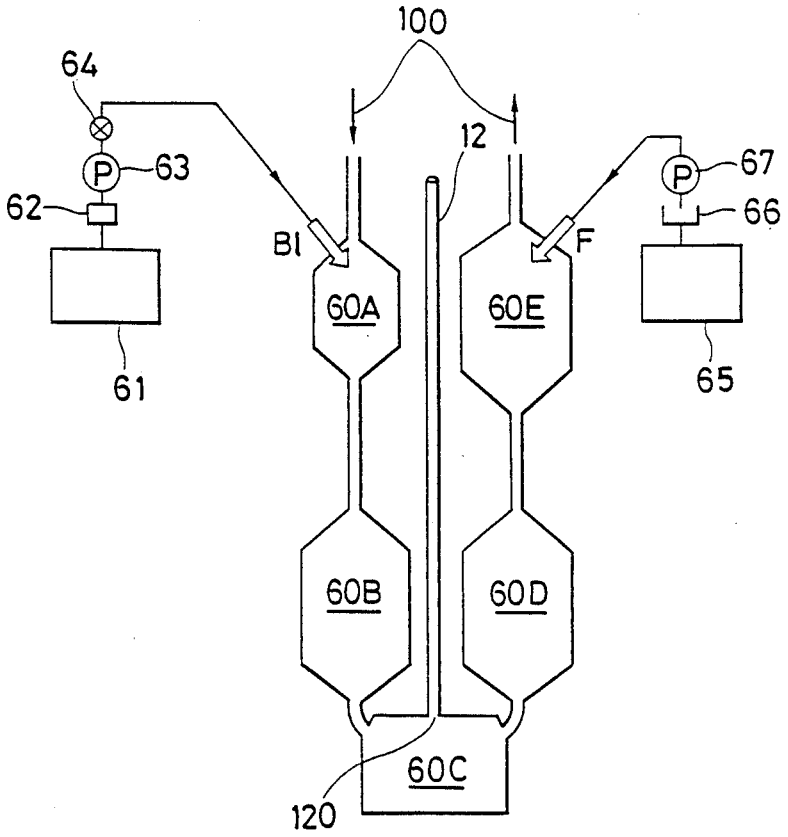
FIG. 13 is a schematic illustration of a photosensitive material processing apparatus according to a further embodiment of the present invention.

Although several embodiments of the processing apparatus wherein the respective compartments have approximately an equal volume have been illustrated, the photosensitive material processing apparatus of the invention is also applicable to an embodiment wherein the respective compartments have different volumes. FIG. 13 shows one preferred embodiment wherein the processing compartment at the first stage has a smaller volume than the remaining compartments.

The apparatus of FIG. 13 may have substantially the same structure as that of FIGS. 1 and 2 except the compartment dimensions, and only the contour of processing compartments and channels is schematically illustrated as in FIGS. 3 to 12.

The apparatus of FIG. 13 has five processing compartments 60A, 60B, 60C, 60D, and 60E. In the illustrated pattern, bleaching solution Bl is delivered into the first compartment 60A and fixing solution F into the fifth compartment 60E while the mixed or exhausted solution is discharged from the third compartment 60C through the outlet port 120.

The first compartment 60*a* through which the photosensitive material 100 passes first and to which bleaching solution Bl is first supplied has a smaller volume than the remaining compartments 60B to 60E. More particularly, the volume v of the first compartment 60A is selected so as to meet the following relationship:

$$v = k\frac{V}{n} \quad (1)$$

wherein V is the total volume of the processing tank (compartments plus channels), n is the number of compartments, and $0<k<1$, k preferably has a value of from 0.1 to 0.8, more preferably from 0.2 to 0.5.

The design of the compartments to meet relationship (1) ensures an increased processing efficiency in that when processing is commenced again after a quiescent period, the solution in the relatively small compartment is shortly displaced by fresh bleaching solution Bl.

In the illustrated embodiment, the total volume V is in the range of from 2 to 20 liters, preferably from 3 to 10 liters, and the first compartment 60A has a volume v of 0.2 to 2 liters, preferably 0.2 to 1 liter.

Generally speaking, the total volume V largely depends on the number of compartments n. Often, the number of compartments n is 3 to 10, preferably 5 to 7, the total volume V ranges from 2 to 20 liters, preferably from 3 to 10 liters, and the compartment to which a bleaching solution is first supplied has a volume v of 0.2 to 2 liters, preferably 0.2 to 1 liter.

The apparatus of the invention is often designed without the shutter means which is depicted at 13 in FIGS. 1 and 2. In such cases, the channels between adjoining compartments each may be about 10 to 200 mm long, preferably 20 to 60 mm long in the travel direction of the photosensitive material.

As shown in FIG. 13, the apparatus further includes a tank 61 for supplying bleaching solution Bl to the first compartment 60A as a replenisher and another tank 65 for supplying fixing solution F to the fifth compartment 60E as a replenisher. The bleaching replenisher Bl in the tank 61 is supplied by a pump 63 to the first compartment 60A through a filter 62. The fixing replenisher F in the tank 66 is supplied by a pump 67 to the fifth compartment 60E through a filter 66.

The apparatus further includes means 64 for detecting the actual feed of bleaching solution Bl supplied from the tank 61 to the first compartment 60A. This feed detector means 64 may be a flowmeter, which is associated with the inlet port for supplying the replenisher and generates a detection signal representative of the feed of bleaching solution Bl. Supply of bleaching solution Bl to the first compartment 60*a* is then controlled on the basis of the detected value.

Figure 14:
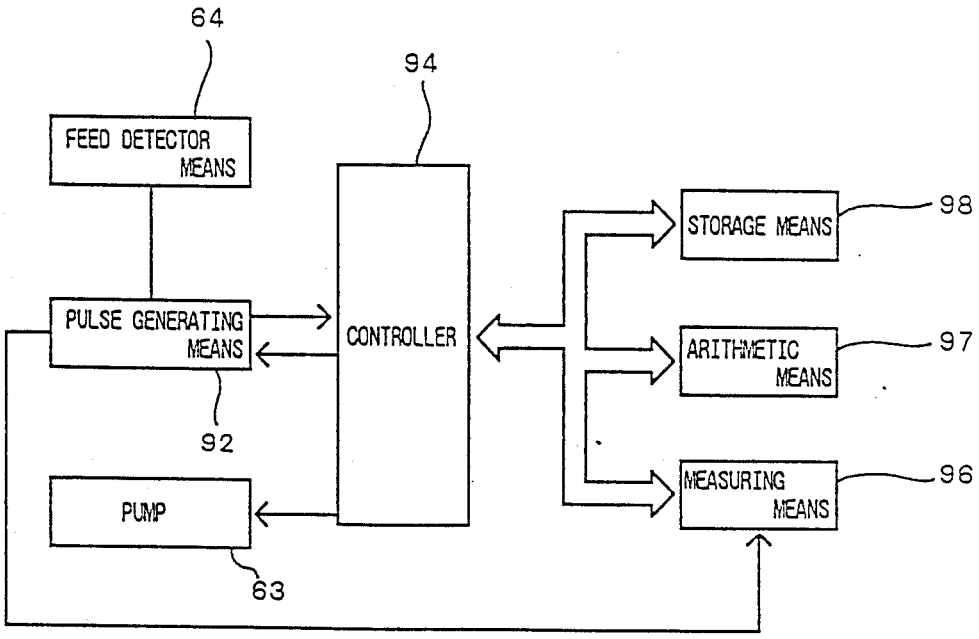
FIG. 14 is a block diagram showing a control system associated with a replenishing mechanism.

An exemplary replenishing system for carrying out such controlled supply of a replenisher is shown in the block diagram of FIG. 14.

In addition to the means 64 for detecting the feed of bleaching solution Bl supplied from the tank 61 to the first compartment 60A, the replenishing system includes means 92 for generating consecutive pulses at fixed intervals in accordance with detected values of the detector means 64 and generating pulses by converting the calculated replenishing amount into a pulse. A controller 94 controls the operation of the pump 63 on the basis of the number of generated pulses. The system further includes means 96 for measuring the number of pulses generated within a predetermined time, means 98 for temporarily storing the difference between the number of pulses generated by the pulse generating means 92 and the number of pulses used to control the pump 63, and arithmetic means 97 for adding the stored pulse number to the number of pulses corresponding to the calculated amount of solution to be subsequently replenished.

The detector means 64 is coupled to the pulse generating means 92 for delivering a detection signal to the latter. The controller 94 is a CPU, for example, for calculating the replenishing amount and delivering the calculated amount to the pulse generating means 92.

The pulse generating means 92 generates pulses in proportion to the detected amount and the calculated amount and delivers the pulses to the controller 94 and the Q measuring means 96.

The controller 94 is coupled to the storage means 98, arithmetic means 97 and measuring means 96. Based on the number of pulses corresponding to the replenishing amount, the number of pulses corresponding to the actual feed, the number of pulses generated within the predetermined time, the sum of the difference between the number of pulses corresponding to the actual feed and the number of pulses used to control the pump plus the number of pulses corresponding to the calculated amount of solution to be subsequently replenished, the controller 94 controls the operation of the pump 63 while feeding back the replenished amount.

Figure 15:
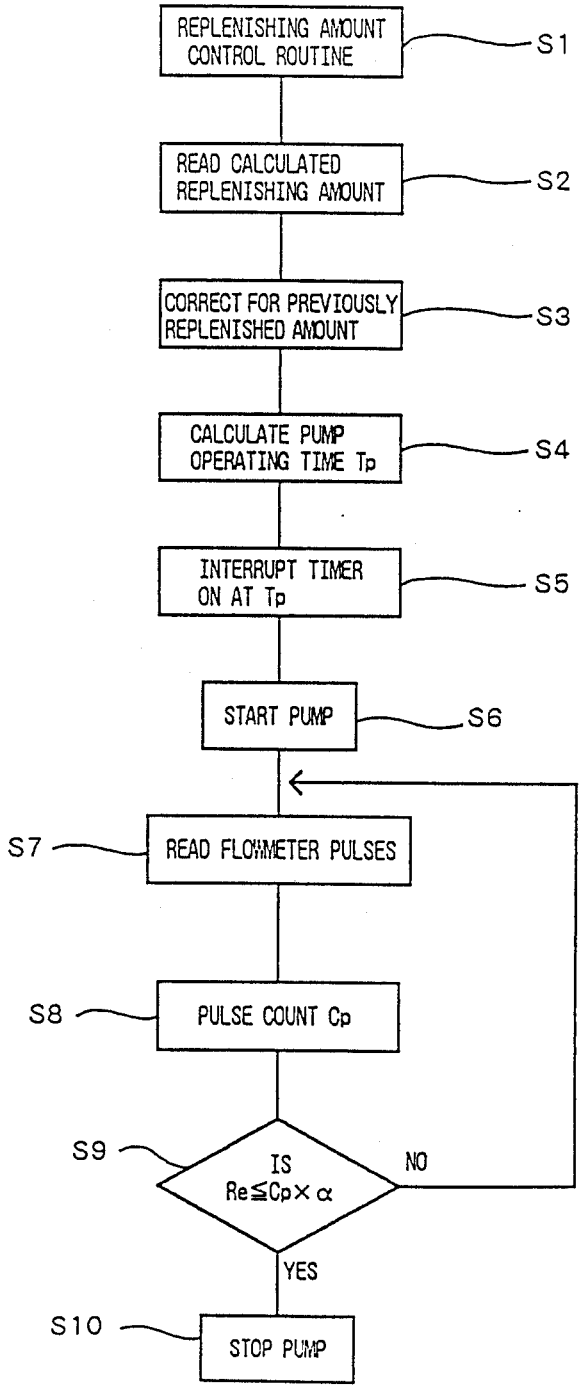
FIGS. 15 and 16 are flow charts of replenishment control algorithms.

FIG. 15 is an algorithm showing how the controller 94 controls replenishing operation.

Step S1 is to calculate the replenishing amount (or target value) according to the replenishing amount control routine, and step S2 is to read the calculated replenishing amount Re. The storage means 98 has stored therein the shortage which has been left unreplenished during the previous replenishing operation due to the relation of the capacity of the pump to the calculated replenishing amount. The storage means 98 has also stored therein the difference between the number of pulses corresponding to the previous shortage and the number of pulses used to control the pump. Then in step S3, the arithmetic means 97 adds the read-out replenishing amount to the difference between the number of pulses corresponding to the previous shortage and the number of pulses used to control the pump, thereby calculating the number of pulses corresponding to the amount to be currently replenished.

Figure 16:
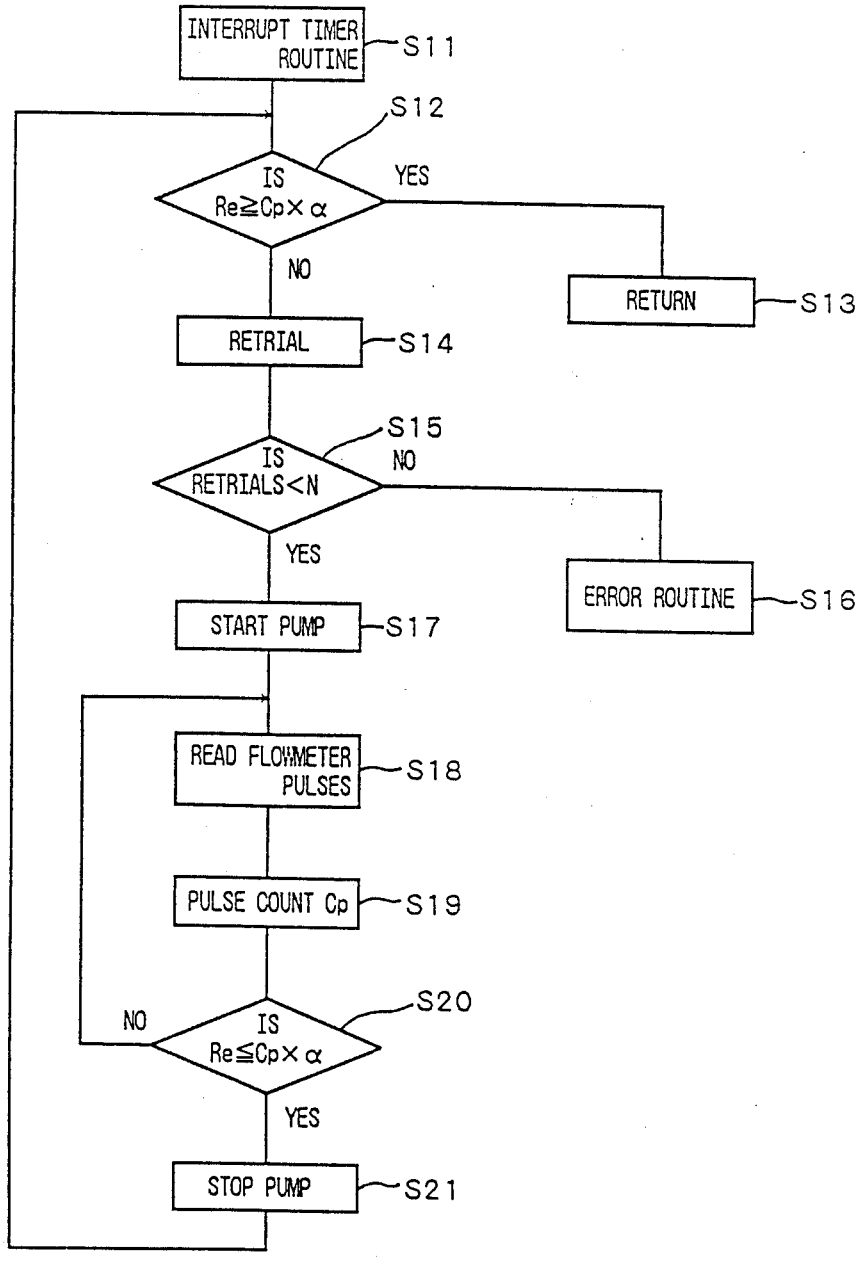

Step S4 is to calculate a replenishing time Tp which is expected to be taken to replenish the current replenishing amount of solution. In step S5, a timer is turned on. After the time Tp has passed, an interrupt timer routine as shown in FIG. 16 starts. It should be understood that the time Tp is the expected replenishing time which is set to be at most a time until the subsequent photosensitive material processing is started, and stored in the storage means 98.

After the timer is turned on in step S5, the algorithm switches to step S6 where the pump 63 is operated. Step S7 is to read the pulses corresponding to the feed detected by the flowmeter. In step S8, the number of pulses Cp is counted.

The algorithm then switches to a decision block S9 for comparing the calculated replenishing amount with the previously replenished amount $Cp \times \alpha$ wherein $\alpha$ is a correction coefficient for converting the number of pulses into a replenishing amount. If the decision block S9 determines that the previously replenished amount $Cp \times \alpha$ has not reached the calculated replenishing amount, then the algorithm switches back to step S7 where the pulses corresponding to the replenishment amount are read again while pumping is continued. If the previously replenished amount $Cp \times \alpha$ is equal to or greater than the calculated replenishing amount, then the algorithm switches to step S10 where the pump 63 is stopped, completing replenishment.

It should be understood that if replenishment is completed before the time Tp has passed, then the interrupt timer routine need not be started.

The interrupt timer routine is described with reference to FIG. 16 which is a flow diagram of the interrupt timer routine.

The timer is turned on at the same time when the pump 63 is actuated. After the time Tp has passed since turning-on of the timer, the interrupt timer routine is started in step S11 and the algorithm switches to a decision block S12 for comparing the calculated replenishing amount Re with the previously replenished amount $Cp \times \alpha$. If the previously replenished amount $Cp \times \alpha$ is equal to or greater than the calculated replenishing amount Re, which means that the calculated replenishing amount has been reached, then the algorithm switches back to step S10 of the control algorithm of FIG. 15 through a step S13 where the pump 63 is stopped, completing replenishment. If the decision block S12 determines that the previously replenished amount $Cp \times \alpha$ is less than the calculated replenishing amount Re, then the algorithm switches to step S14 where a retrial operation to replenish the calculated amount of solution again is effected and the number of retrial operations is counted.

Then the algorithm switches to a decision block S15 for comparing the counted number of retrial operations with the preset number of retrial operations N. If the decision block S15 determines that the counted number of retrial operations is equal to or greater than the preset number of retrial operations N, then the algorithm transfers to step S16 for an error routine, deciding a failure of the replenishing mechanism.

If the counted number of retrial operations is less than the preset number of retrial operations N, then the algorithm switches to steps S17 to S21 where the same operation as steps S6 to S10 in FIG. 15 is taken, completing replenishment.

The interrupt timer routine is further illustrated with reference to FIG. 17, which is a timing chart for starting the interrupt timer routine wherein solid lines correspond to starting and broken lines correspond to non-starting.

Figure 17:
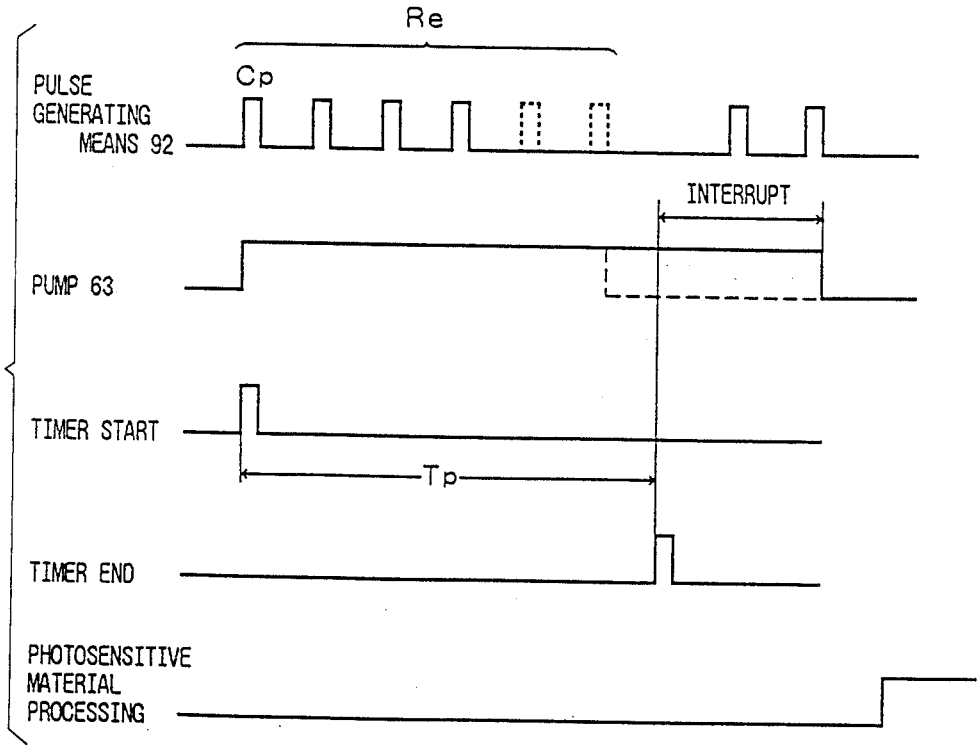
FIG. 17 is a timing chart for replenishment control.

Assume that the number of pulses corresponding to the calculated replenishing amount Re is 6, for example, as shown by broken lines in FIG. 17. If the feed detector means 64 detects the actual feed and the pulse generating means 92 generates 6 pulses, then the controller 94 stops the operation of the pump 63, completing replenishment.

In turn, if only 4 pulses are actually generated in proportion to the actual feed as shown by solid lines, then the time Tp would pass from the start of pump operation before replenishment is completed, and the interrupt timer routine is started. Once the interrupt timer routine is started, the controller 94 delivers an actuating signal to the pump 63 again, allowing the pump 63 to continue operation. When it is determined that the amount corresponding to 2 pulses has been supplied after the start of the interrupt timer routine, the interrupt timer routine is terminated, completing replenishment. The time Tp for starting the interrupt timer routine is set to be within the range from the start of the pump to a point of time between the expected end of replenishment and the start of subsequent photosensitive material processing.

The above-illustrated replenishment method makes it possible to accurately replenish the calculated replenishing amount of solution by detecting predetermined increments of solution replenished, converting the detected increments into pulses at intervals, and stopping operation of the replenisher pumping means at the time when the predetermined number of pulses is reached.

Further, an error in replenishing amount associated with the rating of the replenisher pumping means is stored in the form of a corresponding number of pulses. The operation of the replenisher pumping means for a subsequent replenishment is controlled by adding the number of pulses corresponding to the error to the number of pulses corresponding to the calculated replenishing amount. Then the error is compensated for during repeated replenishments.

Furthermore, over-replenishment can be prevented by controlling the stop of the replenisher pumping means in accordance with the number of pulses corresponding to the feed of replenisher or the number of pulses within the predetermined time. Then the replenisher pumping means does not continue operation when the number of pulses changes largely due to a failure.

Although the first compartment 60A in the embodiment of FIG. 13, which has a smaller volume, tends to experience a replenishment error or a variation in processing capacity due to drag out of a processing solution (e.g., color developer) by the photosensitive material from the preceding tank, this problem can be overcome by the above-mentioned replenishing process.

The same replenishing process is applicable to the replenishment of fixing solution in the embodiment of FIG. 13. Then the fifth compartment 60E to which the fixing solution is first supplied can have a smaller volume as the first compartment 60A.

The above-mentioned structural feature of the apparatus of FIG. 13 permits the respective compartments to be filled with the following processing solutions having different desilvering ability.

Compartment 60A: bleaching solution

Compartment 60B: blix solution containing more bleaching component Q Compartment 60C: blix solution Compartment 60D: blix solution containing more fixing component Compartment 60E: fixing solution In this embodiment, the flow direction of the respective solutions is dictated by their inlet ports and outlet port. The flow of bleaching solution has the same direction as the travel direction of the photosensitive material (parallel flow) whereas the flow of fixing solution has the opposite direction to the travel direction of the photosensitive material (counter flow). Bleaching efficiency is increased by the parallel flow of bleaching solution. The fixing solution assumes a counter flow because during the preceding bleach-fixing, only fixing takes place in the unexposed, undeveloped areas while bleaching first takes place and fixing follows in the developed areas. It is preferred for efficient processing to effect substantial bleaching in the first compartment 60A and substantial fixing in the fifth compartment 60E. Processing efficiency is rather increased by the counter flow of fixing solution.

Therefore, the embodiment of FIG. 13 is effective for a desilvering process including bleaching →bleach-fixing→fixing steps. The prior art apparatus requires at least 3 tanks for such multi-stage desilvering, whereas the present invention permits a single processing tank to efficiently carry out multi stage desilvering.

Although the foregoing description has been made of an apparatus intended for desilvering wherein the compartment to which the processing solution is first supplied has a smaller volume than the remaining compartments, the present invention is equally applicable to any of the embodiments of FIGS. 3 to 12. Further, the present invention is not limited to the illustrated embodiments.

Some modifications may be made when the apparatus is used for other processing purposes. For instance, the apparatus may be used for rinsing or stabilization by charging the path with rinsing water or stabilizing solution. In such a case, an increased efficiency is expected when the last compartment through which the photosensitive material passes last has a smaller volume than the remaining compartments and rinsing water is supplied to the last compartment. When processing solution is pumped to the smaller volume compartment of any embodiments, it is advantageous to control the supply of processing solution on the basis of the detected value of a feed amount.

The processing solutions having different functions used herein generally include a processing solution having a developing function, a processing solution having a desilvering function, a processing solution having a rinsing function, and a processing solution having a stabilizing function. More particularly, the processing solutions having a developing function include black-and-white developers and color developers. The processing solutions having a desilvering function are further classified into a processing solution having a bleaching function and a processing solution having a fixing function, typically bleaching solutions, bleach-fixing solutions, and fixing solutions. The processing solutions having a rinsing function include wash water and rinsing liquid. The processing solution having a stabilizing function is typically a stabilizing solution.

The type of photosensitive material which can be processed in the apparatus of the invention is not particularly limited. Any desired types of photosensitive material may be processed, including color negative films, color reversal films, color photographic paper, color positive films, color reversal photographic paper, printing photographic photosensitive material, radiographic photosensitive material, black-and-white negative films, black-and-white photographic paper, and micro-film photosensitive material.

The photosensitive material processing apparatus of the invention will find a variety of uses such as wet copying machines, automatic developing machines, printer processors, video printer processors, photographic print producing vending machines, and proof color paper processors.

The photosensitive material processing apparatus of the invention has great benefits of a size reduction and a saving of the amount of processing solution replenished.

The apparatus allows at least two types of processing solution having different functions to be supplied to the system at different locations, thereby imparting multiple functions to a single processing tank. This feature contributes to a further size reduction and a saving of processing time. Processing efficiency and photographic properties can be further improved by choosing proper types of processing solution and their supply positions.

Better processing efficiency is expected in the embodiment where the compartment to which processing solution is first supplied has a smaller volume than the remaining compartment because the solution in the smaller compartment is shortly displaced by a fresh solution upon restart of processing after a quiescent time.

In the embodiment where processing solution is first supplied to a smaller volume compartment, pumping the solution in a feedback control mode on the basis of a detected value representative of the actual feed of solution allows the solution to be accurately replenished and maintains the processing ability constant, thus obtaining pictures of improved photographic quality at all times. This feature becomes more advantageous particularly when the apparatus is charged with a processing solution having a desilvering ability which would otherwise be seriously affected by drag-out from the preceding tank.

To demonstrate the benefits of the invention, a series of experiments were carried out.

EXPERIMENT 1

Using color negative films identified as sample No. 201 in Example 2 of Japanese Patent Application Kokai No. 259359/1989 and a modified type of color negative film automatic processor model FP230B manufactured by Fuji Photo-Film Co., Ltd., a running test including a series of continuous steps for color development in the following order was carried out for one month until the accumulative amount of color developer replenished reached 80 liters.

| Processing steps | Temperature | Time | Replenisher amount(1) | Tank volume |
|---|---|---|---|---|
| Color development | 37.8° C. | 3'15" | 23 ml | 9.4 l |
| Bleach | 38.0° C. | 45" | 5 ml | 4.1 l |
| Bleach-fix | 38.0° C. | 45" | (2) | 4.1 l |
| Fix | 38.0° C. | 45" | 48 ml | 4.1 l |
| Rinse (1) | 38.0° C. | 20" | (3) | 3.6 l |
| Rinse (2) | 38.0° C. | 20" | 34 ml | 3.6 l |
| Stabilizing | 38.0° C. | 20" | 20 ml | 1.5 l |
| Drying | 55° C. | 1' | | |

(1)Volume of solution replenished per meter of 35-mm film.
(2)All overflows of the bleaching and fixing tanks were led to the bleach-fixing tank.
(3)Rinsing was in a counterflow mode from tank (2) to (1).

Each processing solution had the following composition.

| Color Developer Ingredients | Mother | Replenisher |
|---|---|---|
| Diethylene triamine pentaacetate | 1.0 g | 1.1 g |
| 1-hydroxyethylidene-1,1-diphosphonic acid | 3.0 g | 3.2 g |

-continued

| | | |
|---|---|---|
| Sodium sulfite | 4.0 g | 4.9 g |
| Potassium carbonate | 30.0 g | 30.0 g |
| Potassium bromide | 1.4 g | — |
| Potassium iodide | 1.5 mg | — |
| Hydroxylamine hydrogen sulfate | 2.4 g | 3.6 g |
| 4-(N-ethyl-N-β-hydroxyethylamino)-2-methylaniline hydrogen sulfate | 4.5 g | 7.2 g |
| Water totaling to | 1.0 l | 1.0 l |
| pH (25° C.) | 10.05 | 10.10 |

| Bleaching solution Ingredients | Mother | Replenisher |
|---|---|---|
| Ammonium iron (III) 1,3-diaminopropane tetraacetate monohydrate | 144.0 g | 206.0 g |
| 1,3-diaminopropane tetraacetic acid | 2.8 g | 4.0 g |
| Ammonium bromide | 84.0 g | 120.0 g |
| Ammonium nitrate | 30.0 g | 30.0 g |
| Aqueous ammonia (27%) | 10.0 g | 1.8 g |
| Acetic acid (98%) | 51.1 g | 73.0 g |
| Water totaling to | 1.0 l | 1.0 l |
| pH (25° C.) | 4.3 | 3.4 |

BLEACH-FIX SOLUTION

A mixture of the mother bleaching solution and the mother fixing solution in a volume ratio of 1:9 was used.

| Fixinq solution Ingredients | Mother/replenisher |
|---|---|
| Disodium ethylenediamine tetraacetate | 1.7 g |
| Sodium sulfite | 14.0 g |
| Sodium bisulfite | 10.0 g |
| Aqueous ammonium thiosulfate (70 w/v %) | 320.0 g |
| Water totaling to | 3 liters |
| pH (25° C.) | 7.2 |

RINSING LIQUID

City water was passed through a mixed bed column loaded with an H type strong acid cation-exchange resin (Amberlite IR-120B by Rohm & Haas Co.) and an OH type anion-exchange resin (Amberlite IR-400) to reduce the calcium and magnesium contents to 3 mg/l or lower. To the deionized water were added 20 mg/l of sodium isocyanurate dichloride and 0.15 g/l of sodium sulfate. This liquid was at pH 6.5 to 7.5.

| Stabilizing solution Ingredients | Mother/replenisher |
|---|---|
| Surface-active agent A* | 0.5 g |
| Surface-active agent B* | 0.4 g |
| Triethanol amine | 2.0 g |
| 1,2-benzisothiazolin-2-one | 0.01 g |
| Methanol | 0.3 g |
| Formalin (37%) | 1.5 g |
| Water totaling to | 1 liter |
| pH (25° C.) | 6.5 |

*Surface-active agent A

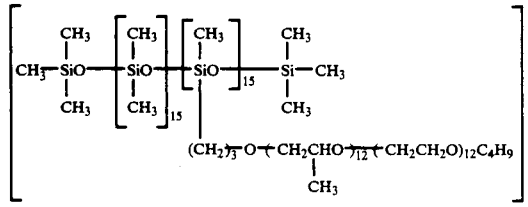

*Surface-active agent B $C_{10}H_{21}—O—(CH_2CH_2O)_{10}—H$ processor including bleaching, bleach-fixing and fixing tanks was replaced by the following apparatus.

PROCEDURE 1B

A processing apparatus having five compartments as shown in FIG. 13 was used. The compartments each had an equal volume of 800 ml. The bleaching solution was supplied to the first compartment 60A and the fixing solution was supplied to the fifth compartment 60E. Replenishers were pumped in an ordinary manner in an amount of 5 ml for the bleaching solution and 48 ml for the fixing solution per meter of 35-mm film.

PROCEDURE 1C

The apparatus shown in FIG. 13 was used. The first compartment 60A had a smaller volume of 150 ml while the remaining compartments each had an equal volume of 800 ml. Replenishment was carried out as in Procedure 1B.

PROCEDURE 1D

The apparatus shown in FIG. 13 was used. The first compartment 60A had a smaller volume of 150 ml while the remaining compartments each had an equal volume of 800 ml. Replenishment was carried out in a feedback control manner using the control system of FIG. 14 on the basis of the detected value of a solution feed.

For each of Procedures 1A to 1D, a running test was conducted for one month by alternately processing a large quantity of photosensitive material for a week and a small quantity of photosensitive material for a next week. Twenty samples were randomly sampled out during the running test to determine photographic performance.

The photographic performance was determined in terms of color recovery deficiency and a variation in photographic performance due to desilvering.

COLOR RECOVERY DEFICIENCY

A photosensitive film which had been subjected to sensitometric exposure and each of Procedures 1A to 1D was measured for density using red light. The film was processed again from the bleaching stage and measured again for density. An increase in density by reprocessing relative to a red transmission density of 1.2 was determined. A density increase of 0.1 or more was evaluated to be color recovery deficient. Deficient samples are rated NO, less deficient samples are rated Fair, and acceptable samples are rated OK.

VARIATION IN PHOTOGRAPHIC PERFORMANCE

The processed photosensitive film was measured for transmission density using green light. Since deficient desilvering resulted in a density increase and the density at a density level of 2.3 varied over a wide range with a degree of desilvering, this variation range was determined by measuring the density at 20 spots and calculating a standard deviation.

TABLE 1

| Procedure | Variation in photographic performance | Color recovery deficiency | Number of processing tanks |
|---|---|---|---|
| 1A* | ±0.22 | NO (markedly occurred during large quantity processing) | 7 |
| 1B | ±0.17 | Fair (occurred during | 5 |

The foregoing procedure is designated Procedure 1A.

TABLE 1-continued

| Procedure | Variation in photographic performance | Color recovery deficiency | Number of processing tanks |
|---|---|---|---|
| | | large quantity processing) | |
| 1C | ±0.08 | Fair (somewhat occurred during large quantity processing) | 5 |
| 1D | ±0.02 | OK (no occurrence) | 5 |

*1A is a prior art apparatus.

As seen from Table 1, Procedures 1B, 1C, and 1D according to the present invention ensure efficient processing of photosensitive material with a smaller number of processing tanks, allowing for a size reduction of processing apparatus.

Improvements in photographic performance are observed in the preferred example (Procedure C) in which the compartment to which the bleaching solution is first supplied has a smaller volume. Further improvements as evidenced by a reduced variation in photographic performance and suppression of color recovery deficiency are achieved by the feedback control replenishment mode using the detected value of a solution feed.

Obviously many variations and modifications of the present invention are possible in the light of the above teachings. It is therefore to be understood that within the scope of the appended claims, the invention may be practiced otherwise than as specifically described.

We claim:

1. In a photosensitive material processing apparatus comprising a processing tank, a plurality of processing compartments partitioned in said tank, the processing compartments being in serial communication to define a continuous processing path which is filled with a processing solution, and means for successively passing a photo sensitive material through the processing compartments along the path whereby the photosensitive material is processed by contact with the processing solution in each compartment, the improvement wherein an inlet is provided in fluid communication with the path for supplying the processing solution thereto and at least one outlet is provided in fluid communication with the path for discharging the processing solution therefrom, said outlet being positioned at a location other than the first compartment through which the photosensitive material passes first and the last compartment through which the photosensitive material passes last.

2. The apparatus of claim 1 wherein at least three processing compartments are partitioned in the tank, and the outlet is connected to an intermediate compartment between the first and last compartments.

3. The apparatus of claim 1 wherein said path includes a channel for providing flow communication between the compartments, and the outlet is connected to the channel.

4. The apparatus of claim 1 wherein a plurality of inlets for respectively supplying a corresponding plurality of processing solutions having different functions are provided at different locations.

5. The apparatus of claim 4 wherein one inlet is provided at a location nearer to the first compartment and another inlet is provided at a location nearer to the last compartment with respect to the outlet.

6. The apparatus of claim 1 wherein the compartment to which the processing solution is first supplied has a smaller volume than the remaining compartments.

7. The apparatus of claim 1 which further comprises means for detecting the amount of the processing solution supplied to the path and controlling the amount of the processing solution to be supplied to the path on the basis of the detected value.

8. The apparatus of claim 1 or 6 wherein the processing solution has desilvering ability and said inlet is provided in direct flow communication with said first compartment so that the processing solution is first supplied to said first compartment.

* * * * *